US009302895B2

(12) United States Patent
Clusserath

(10) Patent No.: US 9,302,895 B2
(45) Date of Patent: Apr. 5, 2016

(54) FILLING MACHINE

(75) Inventor: Ludwig Clusserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 568 days.

(21) Appl. No.: 13/809,775

(22) PCT Filed: May 19, 2011

(86) PCT No.: PCT/EP2011/002501

§ 371 (c)(1),
(2), (4) Date: Jan. 11, 2013

(87) PCT Pub. No.: WO2012/013255

PCT Pub. Date: Feb. 2, 2012

(65) Prior Publication Data

US 2013/0112315 A1 May 9, 2013

(30) Foreign Application Priority Data

Jul. 28, 2010 (DE) ..... 10 2010 032 573

(51) Int. Cl.

| | |
|---|---|
| ***B67C 3/22*** | (2006.01) |
| ***B67C 3/26*** | (2006.01) |
| ***B65B 3/14*** | (2006.01) |

(52) U.S. Cl.

CPC . *B67C 3/225* (2013.01); *B65B 3/14* (2013.01); *B67C 3/22* (2013.01); *B67C 3/2614* (2013.01)

(58) Field of Classification Search

CPC ..... B67C 3/22; B67C 3/2614; B67C 3/225; B65B 3/14

USPC ..... 141/54–59, 94–95, 144–150, 178–179, 141/183, 188, 237, 244, 305; 53/473, 503

See application file for complete search history.

(56) References Cited

U.S. PATENT DOCUMENTS

| | | | | |
|---|---|---|---|---|
| 2,813,555 | A | 11/1957 | Fox et al. | |
| 4,259,999 | A * | 4/1981 | Wada | 141/57 |
| 7,866,123 | B2 * | 1/2011 | Clusserath | 53/202 |
| 8,701,719 | B2 * | 4/2014 | Clusserath | 141/9 |
| 2014/0215965 | A1 * | 8/2014 | Clusserath | 53/167 |

FOREIGN PATENT DOCUMENTS

| | | |
|---|---|---|
| DE | 10 2007 014702 | 9/2008 |
| DE | 10 2007 030559 | 1/2009 |
| JP | 2005-298066 | 10/2005 |
| WO | WO2009/003582 | 1/2009 |

* cited by examiner

*Primary Examiner* — Timothy L Maust
*Assistant Examiner* — Timothy P Kelly
(74) *Attorney, Agent, or Firm* — Occhiuti & Rohlicek LLP

(57) ABSTRACT

A filling machine for filling containers with a liquid filling material, the filling machine includes a transport element with filling elements arranged thereon, each forming a filling point for filling a container. Each filling element has a housing having a discharge opening, a channel formed in the housing. The channel connects to a product line to supply the filling material, and a liquid valve, a measurement system provided separately for each filling element for determining filling level, filling material quantity, or filling material volume in a container, a controlled gas path associated with each filling element, and a control valve fitted to the controlled gas path. At least two filling points and their filling elements define a function-and-process unit, and a control valve is provided in common for a gas path of all filling elements of a function-and-process unit.

20 Claims, 4 Drawing Sheets

FILLING MACHINE

CROSS REFERENCE TO RELATED APPLICATION

This application is the national phase under 35 USC 371 of international application no. PCT/EP2011/002501, filed May 19, 2011, which claims the benefit of the priority date of German application no. 10 2010 032 573.2, filed Jul. 28, 2010. The contents of the aforementioned applications are incorporated herein in their entirety.

FIELD OF DISCLOSURE

The invention relates to a filling machine.

Filling machines for filling bottles or similar containers, in particular for pressure filling and/or pressureless filling of bottles and similar containers in which the containers are arranged lying tightly against the respective filling element, are known in various embodiments.

BACKGROUND

The term "pressure filling" in the sense of the invention generally means a filling method in which the container to be filled lies tightly against the filling element and usually before the actual filling phase, i.e. before opening of the liquid valve, is pre-tensioned via at least one controlled gas path formed in the filling element with a compressed tension gas (inert gas or CO2 gas) which then during filling is increasingly displaced from the container interior as a return gas, also via at least one controlled gas path formed in the filling element, by the filling material flowing into the container. This pre-tension phase can be preceded by further treatment phases, for example an evacuation and/or flushing of the container interior with an inert gas e.g. CO2 gas etc., also via the gas paths formed in the filling element.

The term "pressureless filling" in the sense of the invention generally means a filling method in which the container to be filled lies preferably with its container mouth also tightly against the respective filling element and the container interior, before the actual filling phase i.e. before opening of the liquid valve, is pre-treated for example evacuated and/or flushed with an inert gas for example CO2 gas via controlled gas paths formed in the filling element, wherein then during filling the gas increasingly expelled by the filling material flowing into the container is discharged from the container interior as a return gas via at least one controlled gas path formed in the filling element.

"Containers lying tightly against the filling element" in the sense of the invention means that the container to be filled lies in a manner known to the person skilled in the art with its container mouth tightly against the filling element or pressed against the seal present there and surrounding the at least one discharge opening of the filling element.

"Containers" in the sense of the invention are in particular cans and bottles of metal, glass and/or plastic, but also other packing means which are suitable for filling with liquid or viscous products for pressure filling or for pressureless filling.

The term "substantially" in the sense of the invention means deviations from the precise value by +/−10%, preferably by +/−5%, and/or deviations in form of changes irrelevant to function.

In known filling machines, in particular those of circulating design in which the filling points are provided on a transport element in the form of a rotor that can be driven circulating about a vertical machine axis, the filling elements each have several controllable gas paths each with at least one control valve per gas path, for example three such control valves, to achieve a high flexibility for the filling machine i.e. in order in particular to allow different filling methods optimally adapted to the respective product such as pressure filling, pressureless filling etc. with different treatment phases, in particular also with different pre-treatment and post-treatment phases, such as for example evacuation and/or flushing of the respective container interior before opening the liquid valve, and/or settling of the filling material and/or pressure relief of the container interior after closing of the liquid valve etc. The plurality of control valves means a substantial complexity in construction, assembly and control technology.

SUMMARY

The object of the invention is to provide a filling machine which, without loss of flexibility with regard to different filling methods and without loss of quality of the filling process, allows a substantial reduction in the complexity in construction, assembly and control technology.

The filling machine according to the invention is characterised in that in each case at least two filling points having one filling element are combined into one function or process unit, wherein the at least one controlled gas path or the at least one control valve of this gas path is provided in common for the filling elements of each function and process unit and is controlled in common by the machine controller of the filling machine. Each filling point or each filling element is however equipped with an independent measuring system, in particular to detect the filling height in the respective container and/or the filling material quantity introduced into the respective container and/or the weight of the respective container, and to control the filling element or its liquid valve as a function of the measurement signal from the measurement system. The measurement system is for example a sensor or a return gas pipe to detect and adjust the filling height, a volume or flow meter device to detect the filling material quantity, and/or a weighing cell to detect the weight.

The design according to the invention not only reduces the number of control valves necessary by at least 50% in comparison with conventional filling machines, but achieves a substantial reduction in the control technology complexity and the assembly and maintenance complexity, in particular taking into account the circumstance that in the filling machines conventional today, each filling element has at least three controlled gas paths each with three control valves.

At each individual filling point are provided a container carrier and for example a curve-controlled lift device with which a controlled relative movement is possible between the container carrier and the filling element, preferably a movement of the container carrier is generated relative to the filling element, namely to press the respective container tightly against the filling element and to release the filled container from the respective filling element. The lift devices are for example provided separately for all filling elements or filling points of the filling machine or preferably common to the filling elements or filling points of each function and process unit, which in particular for container carriers for suspended holding of containers (e.g. PET bottles) on a container flange (neck ring) provided below the container opening, leads to further simplification of the filling machine in particular in relation to construction and control technology.

Refinements, advantages and possible applications of the invention arise from the description below of embodiment examples and from the figures. All features described and/or shown in the figures alone or in arbitrary combination are in principle the object of the invention irrespective of their summary in the claims or back reference. The content of the claims is also declared an element of the description.

BRIEF DESCRIPTION OF THE FIGURES

The invention is explained in more detail below with reference to the figures with embodiment examples. These show.

DETAILED DESCRIPTION

Figure 1:
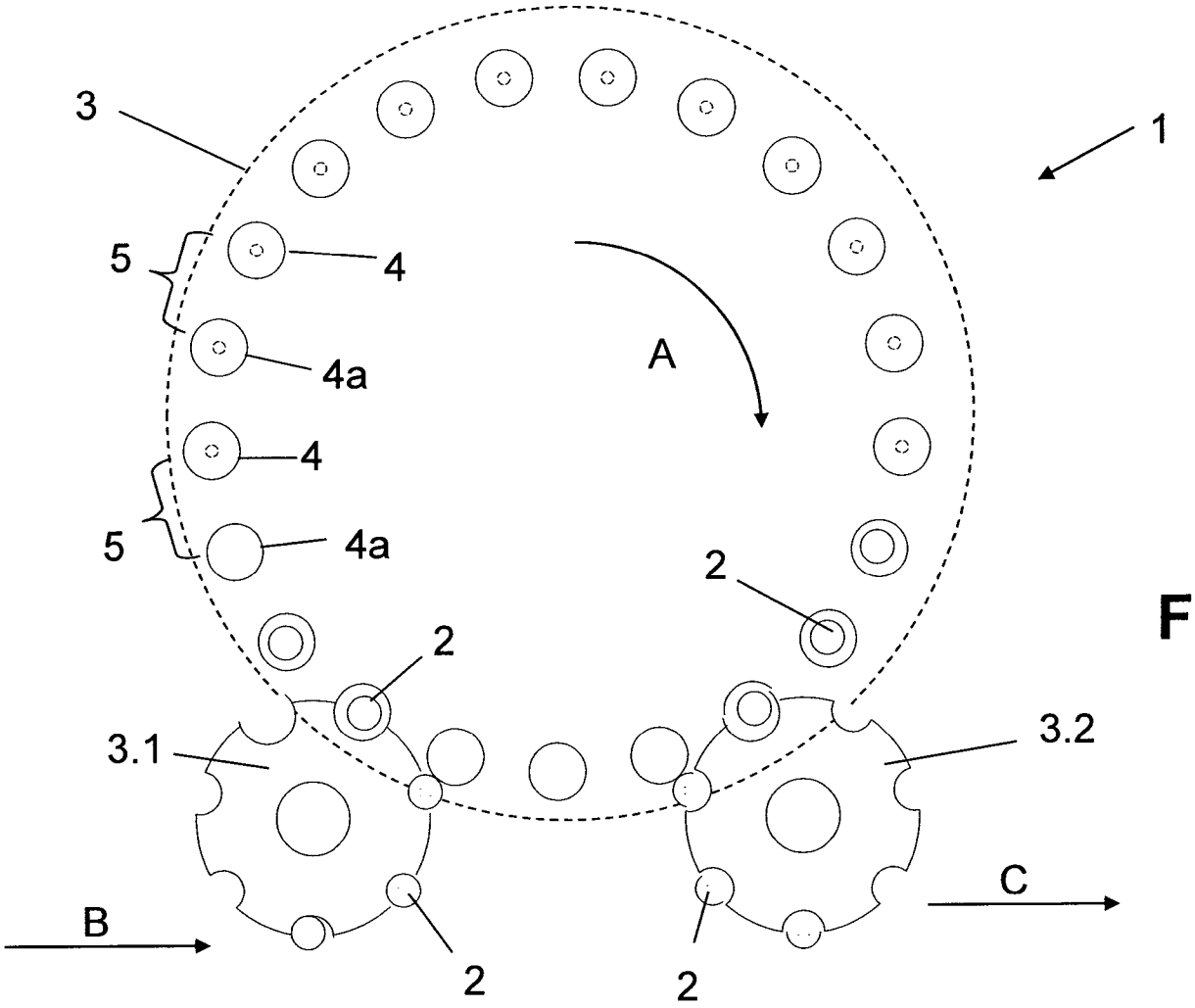
FIG. 1 in highly schematic depiction and in top view, a filling machine of circulating type with a plurality of filling points arranged on the periphery of a rotor that can be driven circulating about a vertical machine axis.
Figure 2:
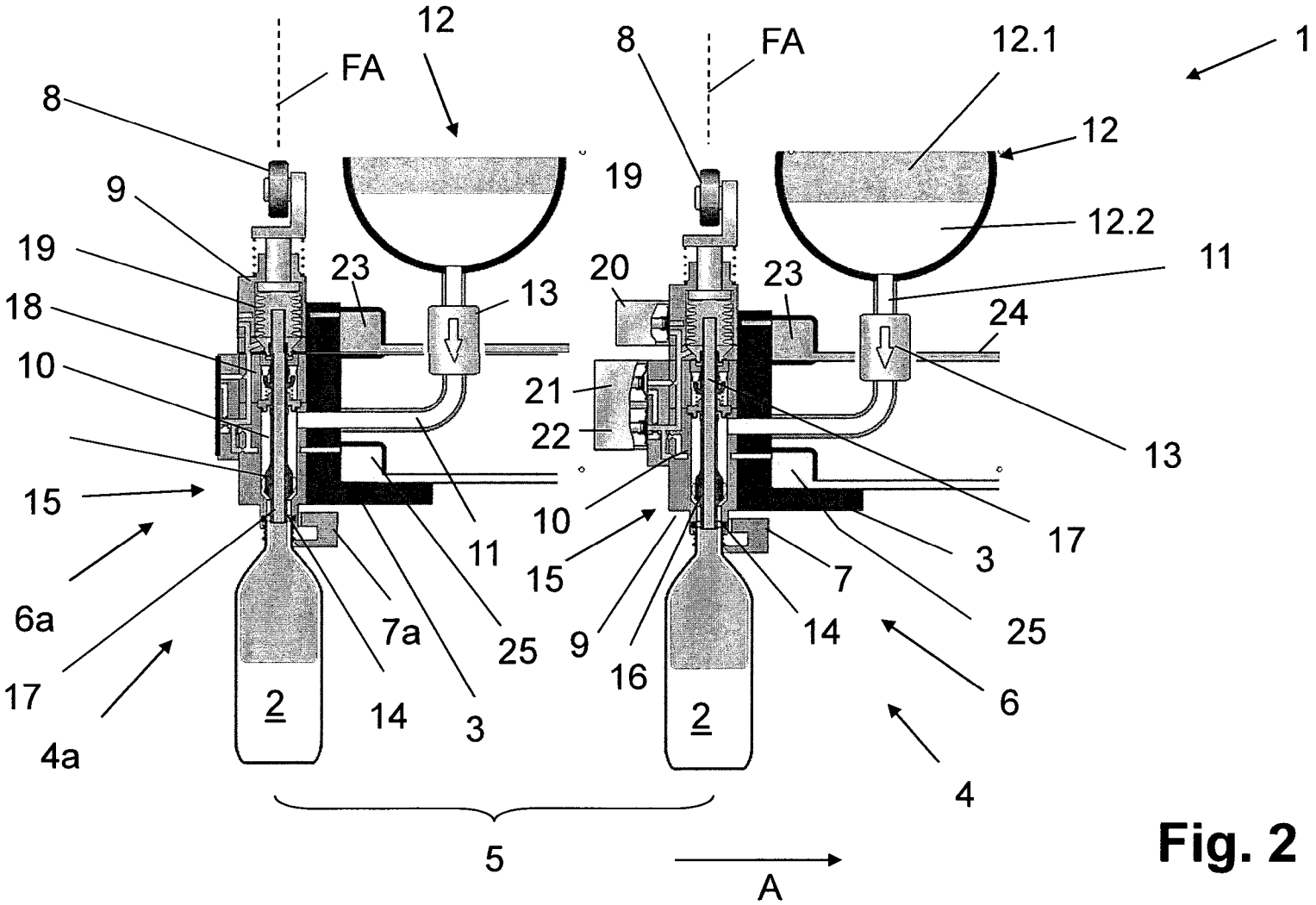
FIG. 2 two successive filling points in the direction of rotation of the rotor, forming a function and process unit.

The filling machine designated generally as 1 in FIGS. 1 and 2 serves to fill containers in the form of bottles 2 with a liquid filling material and is formed as a filling machine of circulating type with a rotor 3 that can be driven circulating about a vertical machine axis in the direction of arrow A. This rotor on its peripheral region has a plurality of filling points 4 and 4*a* which are there provided distributed around the machine axis at even angular and pitch intervals such that in the rotor rotation direction A, a filling point 4 is always followed by a filling point 4*a* and a filling point 4*a* is always followed by a filling point 4. In each case one filling point 4 and one filling point 4*a* form a function and process unit 5 to be described in more detail below. In the embodiment shown, the filling point 4 precedes the filling point 4*a* in each function and process unit 5 in relation to the rotor direction of rotation A.

The empty bottles to be filled are each supplied individually to the filling points 4 and 4*a* at a container inlet 3.1 formed for example by a transport star. The filled bottles 2 are taken from the filling points 4 and 4*a* via a container outlet formed for example by a transport star, as indicated by arrows B and C in the FIG. 1.

FIG. 2 shows two filling points 4 and 4*a* forming such a function or process unit 5, of which the filling point 4 substantially comprises a filling element 6 and a container carrier 7, and the filling point 4*a* substantially comprises a filling element 6*a* and a container carrier 7*a*. The container carriers 7 and 7*a* in the embodiment shown are designed such that the respective bottle 2 is held with a bottle or neck flange suspended on the container carrier 7 or 7*a*, namely with its bottle axis coaxial with a vertical filling element axis FA. The two container carriers 7 and 7*a* in the embodiment shown can each be moved curve-controlled up and down in the direction of filling element axis FA, namely between a lowered state at container inlet 3.1 to receive the bottle 2 to be filled and at a container outlet 3.1 for discharge of the filled bottle 2, and a raised state in which the respective bottle 2 is raised during the filling process with its bottle mouth lying tightly against the filling element 6 or 6*a*.

In the embodiment shown the lift movement of all container carriers 7 and 7*a* and hence also the container carriers 7 and 7*a* of each function and process unit 5 is controlled individually by curve rollers 8 which cooperate with a control curve not shown which does not circulate with the rotor 3.

The filling elements 6 and 6*a* are formed identical apart from the differences to be described below. In detail the filling element 6 comprises a liquid channel 10 formed in a filling element housing 9, which channel at its upper region is connected via a product line 11 with a boiler 12 common to all filling elements 6 and 6*a* of filling machine 1. During the filling operation, the boiler 12 is partly filled with the liquid filling material so that in the boiler 12, a gas chamber 12.1 is formed above the filling material level and a fluid chamber 12.2 below this level into which the product line 11 opens.

In the product line 11 of each filling element 6 and 6*a* is arranged an independent flow meter 13, the signal from which controls the precise quantity or volume filling of the bottles 2. On the underside of the filling element housing 9, the liquid channel 10 forms a discharge opening 14 to discharge the liquid filling material into the respective bottle 2 which is arranged with its bottle opening lying tightly against the filling element 6 via a seal not shown which surrounds the discharge opening 14 in a ring-like manner.

In the liquid channel 10, before the discharge opening in the flow direction of the filling material, is arranged a liquid valve 15 with a valve body 16 cooperating with a valve surface on the inner face of the liquid channel 10, which valve is provided on a return gas pipe 17 acting as the valve tappet and with this return gas pipe 17 via an activation device 18 can be moved under control up and down to open and close the liquid valve 15 in the direction of filling element axis FA.

The return gas pipe 17 protruding downwards with its lower open end above the annular discharge opening 14 is a common component of several controllable gas paths formed in the filling element housing 9 with which the upper, also open return gas pipe 17 extending into a closed chamber 19 is connected via this chamber.

In the embodiment shown each filling element 6 has three controlled gas paths each with one control valve (gas cylinder) 20, 21, 22 which controls the respective gas path and is preferably activatable pneumatically. Via the gas path containing the control valve 20, when the control valve 20 is open the return gas pipe 17 is connected with a ring channel 23 common to all filling elements 6 and 6*a* on the rotor 3, which via at least one line 24 is connected to the gas chamber 12.1 of the boiler 12. Via the gas path containing control valve 22, when the control valve 22 is open the return gas pipe 17 is connected with a ring channel 25 common to all filling elements 6 and 6*a* on the rotor 3 which e.g. serves on filling as a pressure relief channel (in pressure filling) to relieve the pressure after filling or as a vacuum channel to evacuate the bottle 2 before filling etc. With the gas path containing the control valve 21, when the control valve 21 is open, the return gas pipe 17 is connected choked with the ring channel 25 for example for slow pressure relief of the filled bottle 2 or for slow residual filling or braked filling of the respective bottle 2. Evidently the number of controlled gas paths and hence the number of control valves 20-22 can also be greater than three.

The filling elements 6*a* are designed identical to filling elements 6 but so that the controllable gas paths formed in the filling element housing 9 of the filling element 6*a* are part of the controllable gas paths of the respective allocated filling element 6 of the function and process unit 5, i.e. control valves 20-22 are provided only once for both filling elements 6 and 6*a* of each function and process unit 5, namely in the embodiment shown on the respective filling element 6. Consequently the gas paths of both filling elements 6 and 6*a* of each function and process unit 5 are controlled in common. Each filling element 6*a* is however connected to the boiler 12 via its own product line 11 with its own flow meter 13.

The opening of the liquid valve 15 of the two filling elements 6 and 6*a* for each function and process unit 5 takes place for example at the same time for example by corresponding control of the activation devices 18. Without great control complexity however the opening of the liquid valve 15 of the filling element 6*a* can take place with a time delay, for example with a time delay of 100 milliseconds, in relation to the opening of the liquid valve 15 of filling element 6 in each function and process unit 5. The closing of the liquid valve 15 on both filling elements 6 and 6*a* of each function and process unit 5 takes place individually controlled by the flow meter 15 or by another measurement or sensor element assessing the filling height in the bottles 2 and/or the quantity of filling material introduced into the bottles 2, for example by a sensor to determine the filling height, by an extended return gas pipe, by a weighing device etc.

The control valves 20-22 common to the controlled gas paths of the filling elements 6 and 6*a* of each function and process unit 5 lead to a substantial reduction in constructional complexity, production costs and control technology complexity by reducing the number of necessary control valves 20-22 on the filling machine by at least 50%. The design according to the invention also allows a reduction in the angular or pitch interval between the filling points 4 and 4*a* and hence an increase in the number of filling points for the same rotor diameter. Thus for example with a filling machine for filling materials containing CO2 e.g. for filling beer, for the conventional rotor diameter the number of filling points can be increased by at least 10%.

The filling elements 6 and 6*a* are suitable for different filling methods, for example for pressure filling of the bottles 2 with the liquid filling material with pretensioning of the bottles 2 before opening of the liquid valve 15 with a tension gas under pressure from the ring channel 23 or the gas chamber 12.1 of the boiler 12, but also for pressureless filling in which the gas chamber 12 also filled with inert gas is exposed to ambient pressure or a pressure slightly above ambient pressure.

Depending on the filling method concerned, the controlled gas paths with control valves 20, 21 and 22 serve to perform the common control e.g. of the phases of evacuation, pretension, settling and pressure relief in the filling process at both filling elements 6 and 6*a* of each function and process unit 5, namely with the process times stored in the machine controller or in the computer there which apply to both filling elements 6 and 6*a* of the same function and process unit 5.

It has been assumed above that the lift movement of all container carriers 7 and 7*a* is controlled individually. For further simplification and reduction in particular of the constructional complexity and for further reduction of the pitch interval of the filling points, it is also possible to raise and lower the container carriers 7 and 7*a* of each function and process unit 5 with a common lift device.

Figure 3:
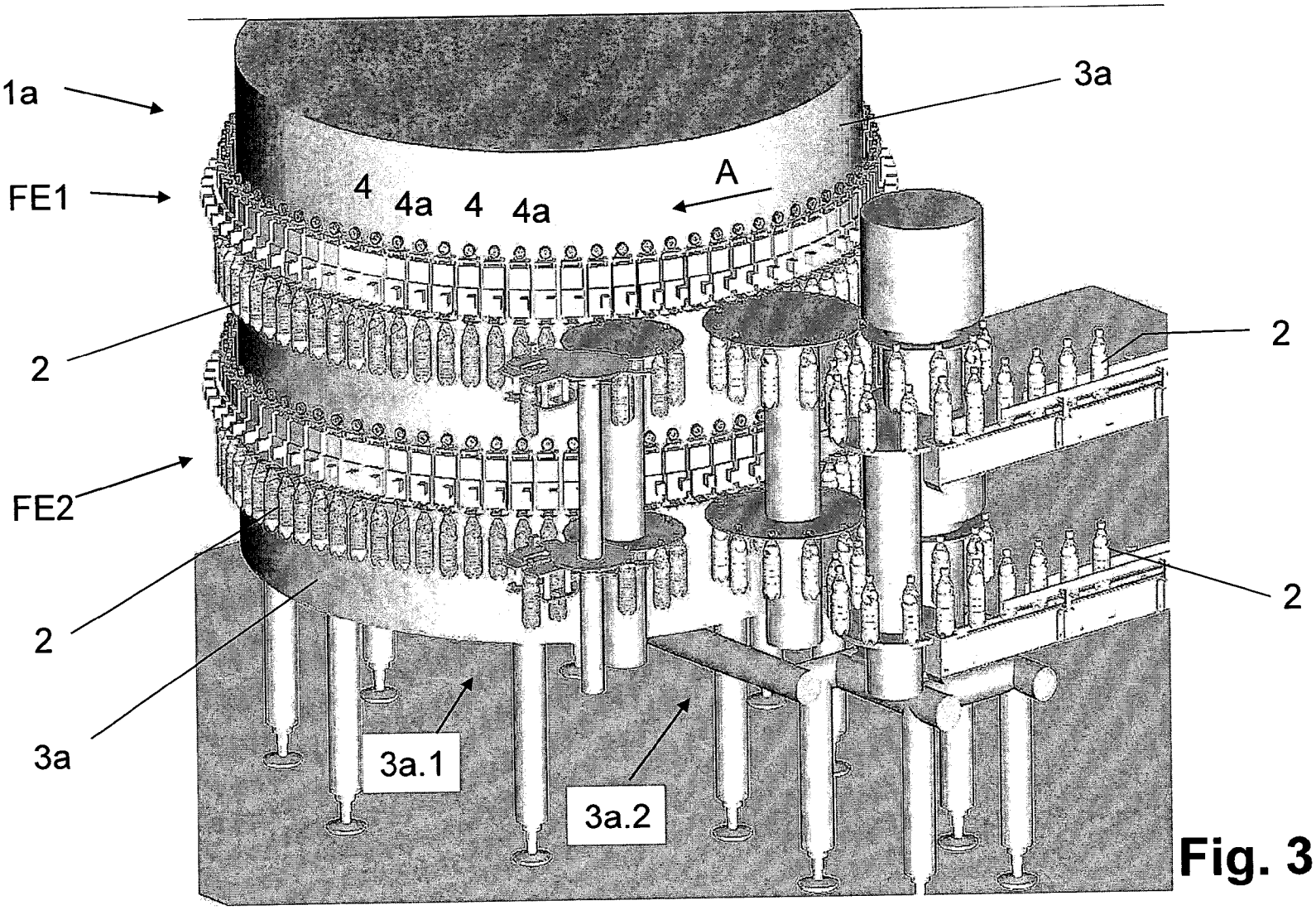
FIG. 3 in schematic perspective view, a filling machine of circulating type corresponding to a further embodiment of the invention.
Figure 4:
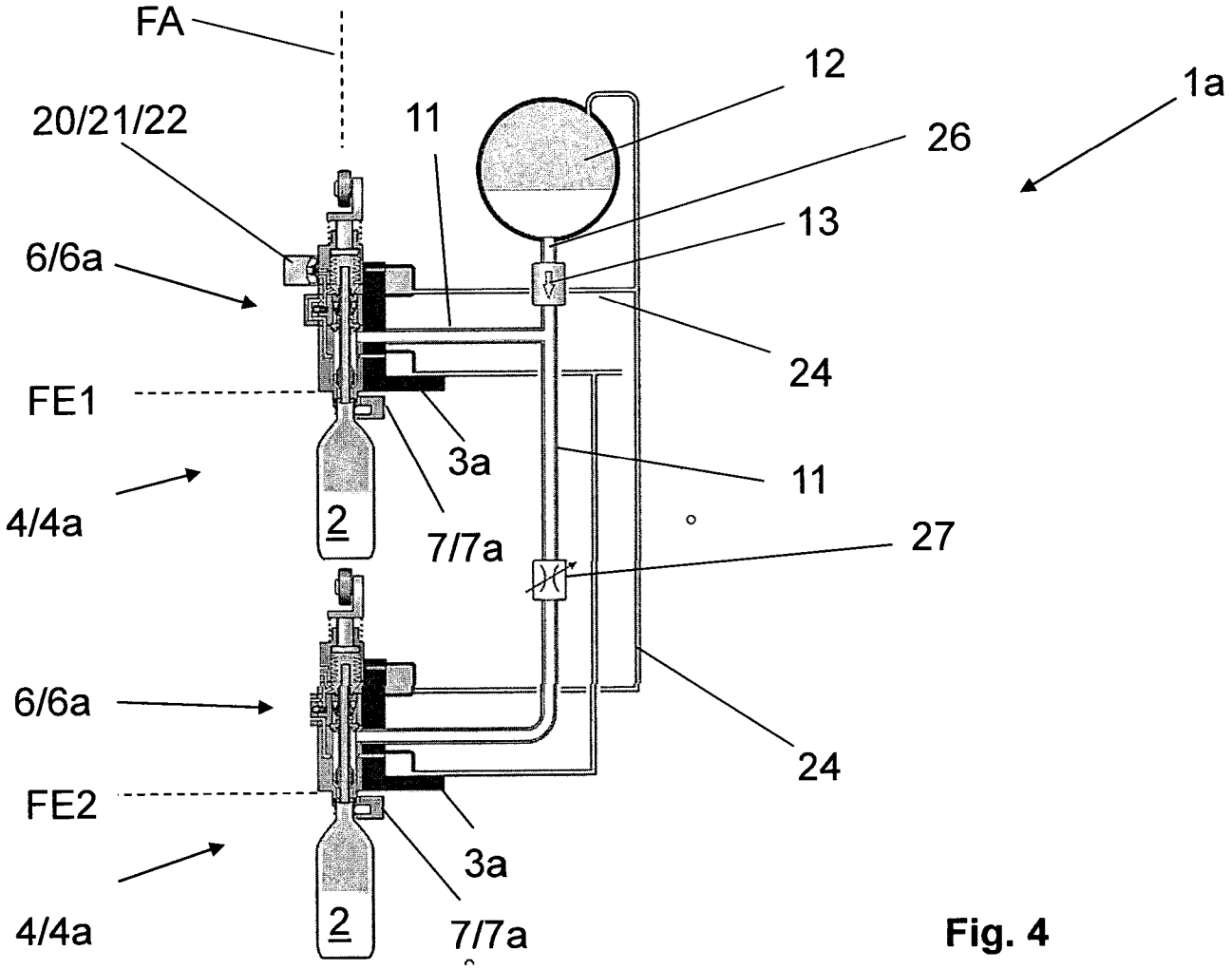
FIG. 4 two filling points arranged in different filling levels on the filling machine in FIG. 3.

FIGS. 3 and 4 show diagrammatically a filling machine 1*a* which differs from the filling machine 1 substantially only in that the filling points 4 and 4*a* on rotor 3*a* are provided in two filling levels FE1 and FE2 offset in relation to each other in the direction of the vertical machine axis, namely filling points 4 and 4*a* are again provided in each filling level FE1 and FE2, for example such that below each filling element 6 of the upper filling element level FE1 is a filling element 6 of the lower filling element level FE2, and below each filling element 6*a* of the upper filling level FE1 is a filling element 6*a* of the lower filling level FE2.

The bottles 2 to be filled are supplied to the filling machine 1*a* or filling points 4 and 4*a* in two levels via container inlets 3*a*.1 there. The filled bottles 2 are also removed from filling points 4 and 4*a* on two levels at container outlets 3*a*.2. As in the filling machine 1, the filling points 4 and 4*a* forming a function and process unit are provided successively in each filling level FE2 and FE1 in the direction of rotation A of rotor 3*a*, wherein at least the liquid valves of filling elements 6 and 6*a* of each function and process unit are controllable individually, while the control valves 20, 21, and 22 for the filling elements of each function and process unit are again provided in common. The container carriers 7 and 7*a* of each function and process unit can be moved either individually or in common relative to the respective filling elements 6 or 6*a*.

One filling element 6 and 6*a* of filling level FE1 and one filling element 6 or 6*a* of filling level FE2 are each connected via their product line 11 to a common product line 26 leading to the fluid chamber 12.2 of the boiler 12, in which line is provided the flow meter 13, in this embodiment common for filling elements 6 and 6*a* of both filling levels FE1 and FE2. A preferably adjustable choke 27 arranged in the product line 11 of the lower filling level ensures that despite the height difference in filling levels FE1 and FE2, the filling material quantity flowing per time unit to the lower filling element 6 and 6*a* when the liquid valve 15 is open is the same as the filling material quantity which flows to the upper filling element 6 or 6*a* when the liquid valve 15 is open. By use of the common flow meter 13, not only the opening but also the closing of the liquid valves 15 of the two filling elements 6 and 6*a* arranged above each other takes place simultaneously triggered by a measurement signal generated by the flow meter 13 when the quantity of filling material detected by the flow meter 13 is equal to twice the filling material quantity to be introduced into each bottle 2. In principle however it is possible to provide a separate flow meter 13 for each filling element 6 and 6*a* in each product line 11, or to detect individually with other measurement or sensor means the filling height achieved in the respective bottle and/or the quantity of filling material introduced into the respective bottle, and thus control individually the liquid valves 15 of the filling elements 6 or 6*a* arranged above each other, i.e. to close them individually on reaching a desired filling material height or quantity.

The invention has been described above with reference to embodiment examples. It is evident that numerous changes and derivations are possible without leaving the concept fundamental to the invention. Thus it is possible for example that the control valves controlling the gas paths of the filling elements 6 and 6*a* of the respective function and process unit 5 or 5*a* are provided not on one of the filling elements or the filling element housing 9 there, but at a separate control block.

It has been assumed above that the filling elements 6, 6*a* allocated to each other and forming a function and process unit 5, even in the embodiment shown in FIGS. 3 and 4, are arranged in a common filling level FE1 and FE2. In principle however it is possible that the allocated filling elements 6 and 6*a* are provided in different filling levels, for example the filling elements 6 in the upper filling level FE1 and the filling elements 6*a* in the lower filling level FE2, for example such that below each filling element 6 is provided the allocated filling element 6*a*, wherein again the upper filling element 6 and the lower filling element 6*a* form a function and process unit 5 at which the control valves 20-22 for the gas paths are provided in common.

LIST OF REFERENCE NUMERALS

1, 1*a* Filling machine
2 Bottle
3, 3*a* Rotor

4, 4*a* Filling point
5 Function and process unit
6, 6*a* Filling element
7, 7*a* Container carrier
8 Curve roller
9 Filling element housing
10 Liquid channel
11 Product line
12 Boiler
13 Flow meter
14 Discharge opening
15 Liquid valve
16 Valve body
17 Return gas pipe
18 Activation device
19 Chamber
20-22 Control valve
23 Ring channel
24 Line
25 Ring channel
26 Product line
27 Choke
A Rotor direction of rotation
B Bottle supply
C Bottle discharge
D Lift movement of container carrier 7 or 7*a*
FA Filling element axis

The invention claimed is:

1. An apparatus comprising a filling machine for filling containers with a liquid filling material, said filling machine comprising a transport element, filling elements, and function-and-process units, wherein each of said function-and-process units is formed by a pair of said filling elements, wherein said function-and-process units comprise a first function-and-process unit, wherein said first function-and-process unit comprises first and second filling elements selected from said filling elements, a first gas path, and a first control valve, wherein said first and second filling elements form first and second filling points for filling containers with said liquid filling material, wherein said first filling element comprises a first filling element housing that comprises a discharge opening for said liquid filling material, a first liquid channel formed in said first filling element housing and connecting to a product line that supplies said liquid filling material, a first liquid valve, and a first measurement system for measuring a quantity, wherein said second filling element comprises a second filling element housing that comprises a discharge opening for said liquid filling material, a second liquid channel formed in said second filling element housing and connecting to a product line that supplies said liquid filling material, a second liquid valve, and a second measurement system for measuring said quantity, wherein said first gas path is common to said first and second filling elements, wherein said first control valve controls flow in said first gas path, wherein said first control valve is common to said first and second filling points, and wherein said quantity is selected from the group consisting of a filling level of said liquid filling material in a container, a quantity of said liquid filling material in a container, and a volume of said liquid filling material in a container.

2. The apparatus of claim 1, wherein said transport element comprises a rotor.

3. The apparatus of claim 1, wherein said first and second filling elements are adjacent to each other on said transport element and successive along a transport direction of said transport element.

4. The apparatus of claim 1, wherein each filling point comprises a container carrier associated with a filling element, said container carrier comprising lifting means for generating a controlled relative movement between said associated filling element and said container carrier to generate a controlled lift movement of said container carrier relative to said associated filling element.

5. The apparatus of claim 1, wherein said first and second filling elements comprise second and third gas paths controlled by corresponding second and third control valves, said second and third control valves being provided in common for all filling elements of said first function-and-process unit.

6. The apparatus of claim 1, wherein said first and second filling elements comprise second and third gas paths controlled by corresponding second and third control valves, wherein at least one of said first, second, and third control valves and a corresponding one of said first, second, and third gas paths thereof are formed for evacuation of a container.

7. The apparatus of claim 1, wherein said first and second filling elements comprise second and third gas paths controlled by corresponding second and third control valves wherein at least one of said first, second, and third control valves and corresponding one of said first, second, and third gas paths are formed for pre-tensioning a container with a pre-tensioning gas.

8. The apparatus of claim 1, wherein said first and second filling elements comprise second and third gas paths controlled by corresponding second and third control valves, wherein at least one of said first, second, and third control valves and a corresponding one of said first, second, and third gas paths are formed for settling of a container arranged tightly against said filling element after filling.

9. The apparatus of claim 1, wherein said first and second filling elements comprise second and third gas paths controlled by corresponding second and third control valves, wherein at least one of said first, second, and third control valves and corresponding one of said first, second, and third gas paths are formed for pressure relief of a filled container to ambient pressure.

10. The apparatus of claim 1, wherein said first controlled gas path connects a return gas pipe that opens into an interior of a container lying tightly against said first filling element with a gas channel common to said filling elements of said filling machine, said common gas channel being connected to a gas chamber of a boiler providing said liquid filling material.

11. The apparatus of claim 1, wherein said first controlled gas path connects a return gas pipe that opens into an interior of a container lying tightly against said first filling element with a gas channel common to said filling elements of said filling machine, said gas channel being connected to a vacuum source.

12. The apparatus of claim 1, wherein said first controlled gas path connects a return gas pipe that opens into an interior of a container lying tightly against said first filling element with a gas channel common to said filling elements of said filling machine, said gas channel being vented to the atmosphere.

13. The apparatus of claim 1, wherein said filling machine is configured for pressure filling of containers lying tightly against said filling elements.

14. The apparatus of claim 1, wherein said filling machine is configured for pressureless filling of containers lying tightly against said filling elements.

15. The apparatus of claim 1, wherein said function-and-process units are provided in a single filling level.

16. The apparatus of claim 1, wherein said function-and-process units are distributed among at least two filling levels offset from each other in a vertical direction on said transport element.

17. The apparatus of claim 1, wherein said filling elements are distributed among at least two different filling levels.

18. The apparatus of claim 1, further comprising a controller for causing simultaneous opening of liquid valves of filling elements of each function-and-process unit.

19. The apparatus of claim 1, further comprising a controller for opening liquid valves such that in each function-and-process unit, liquid valves of said first and second filling elements are opened at different times, said different times being separated by a time delay.

20. The apparatus of claim 19, wherein said time delay is selected to be between 60 and 140 milliseconds.

* * * * *